United States Patent [19]

Hassler

[11] 4,192,645

[45] Mar. 11, 1980

[54] TUNNEL OVEN FOR BAKING CERAMIC PRODUCTS

[76] Inventor: Andreas Hässler, Jahnstr. 45, D-7904 Erbach, Fed. Rep. of Germany

[21] Appl. No.: 876,765

[22] Filed: Feb. 10, 1978

[30] Foreign Application Priority Data

Feb. 11, 1977 [DE] Fed. Rep. of Germany ..... 2705783
Oct. 6, 1977 [DE] Fed. Rep. of Germany ..... 2744975
Nov. 26, 1977 [DE] Fed. Rep. of Germany ..... 2752949

[51] Int. Cl.[2] ..... F27B 9/00
[52] U.S. Cl. ..... 432/144; 432/145; 432/148; 432/149
[58] Field of Search ..... 432/136, 137, 143, 144, 432/145, 148, 149, 150

[56] References Cited

U.S. PATENT DOCUMENTS 1,874,516 8/1932 Hartford ..... 432/137 X

FOREIGN PATENT DOCUMENTS 2263087 of 1975 France ..... 432/144

*Primary Examiner*—John J. Camby
*Attorney, Agent, or Firm*—Pollock, Vande Sande and Priddy

[57] ABSTRACT

A tunnel oven of elongated configuration and having at least one movable carriage therein for transporting ceramic products to be baked through the tunnel, is provided with a reversible blower operative to generate a stream of gas having reciprocating movement which passes through the tunnel in a direction opposite to the direction of movement of the carriage. The opposing sides of the tunnel are provided with inwardly extending projections and intervening recesses which give the overall tunnel a zig-zag or wave configuration; and fire stations are located adjacent the various projections or recesses for heating the reciprocating stream of gas and for producing cross currents which cause the stream to flow along a generally sinuous path through the tunnel in a flow direction opposite to the direction of movement of the carriage.

19 Claims, 8 Drawing Figures

TUNNEL OVEN FOR BAKING CERAMIC PRODUCTS

Figure 1:
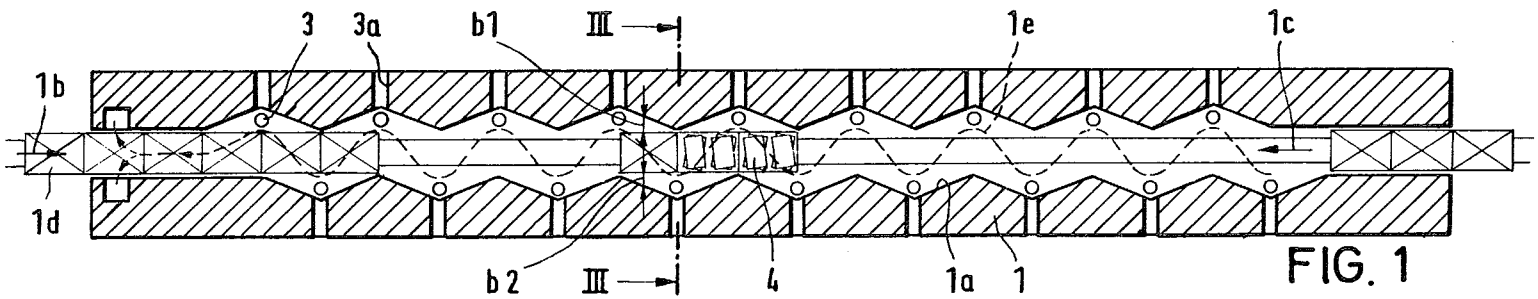

The invention concerns a tunnel oven for baking ceramic products, particularly of the type heated by solid fuels.

Tunnel ovens for ceramic products are fired in most cases by gas or oil. There are also known tunnel ovens in which the firing takes place with the aid of grill fires using solid fuel, arranged at the sides of the tunnel. With such grill fires, fire niches are provided in the lining of the baking tunnel. Firing at the sides has the considerable disadvantage that only relatively narrow baking tunnels can be used, because with the usual longitudinal flow, the heat is insufficient in the middle part of the baking tunnel and thus in the middle part of the load.

Direct firing with solid fuels from above permits the use of a wider baking tunnel, however, in this case, it is very disadvantageous that the ash falls onto the wares.

In view of this state of the art, the purpose of the invention is to provide an oven of the type mentioned above, in which a relatively wide baking tunnel is possible, and in which solid fuels such as wood, coal or the like may be used without layers of ash remaining on the wares or on the carriage surfaces. The oven should have a stream of gas which provides an efficient transfer of heat between the wares and the gas right down to the middle of the load, even in baking tunnels of great width. Furthermore, the arrangement should be such that it is possible to effect a continual forward movement through the tunnel of the carriages which carry products to be baked therein.

To achieve this purpose, according to the invention, it is suggested that inwardly extending projections with opposing recesses are alternately arranged along the side walls of the baking tunnel, and that in opposition to the direction of the carriages along the length of the oven, a main stream of gas is directed which is so influenced by an alternating flow of gas that a reciprocating progression of the entire flow in a direction opposite to the movement of the carriages results.

It has proved advantageous thereby, that the two inner side walls of the baking tunnel are substantially zigzag or wave shaped, and thus form a zigzag or wave shaped tunnel.

It is of further advantage thereby, that the sum of the cross-sectional areas of the two free spaces between the carriage load and the internal side walls of the tunnel is substantially constant throughout the length of the tunnel oven.

The form and arrangement of the side walls of such a tunnel oven converts the longitudinal gas flow to currents crossing the axis of the tunnel, and passing over the fired niches. The heat produced in the niches is thus conveyed to the inner regions of the load. In the tunnel oven according to the invention, the heat is conveyed from both sides to the middle of the tunnel. This can be supplemented by arranging the stacks of wares to be baked in such a manner that passageways are formed between the stacks at acute angles across the tunnel, thus providing an easy passage for the flow of cross currents between the stacks from the diagonally opposite heating niches or heating projections.

The gas flows substantially on a zigzag or sinuous course through the tunnel oven.

According to the invention, it is also possible that the fire positions or fire-producing devices are situated within the recesses.

According to a further suggestion of the invention, the fire positions can also be situated within the inwardly extending projections, and inlet or outlet ports for the heating gasses are provided in the inwardly facing walls of the projections. This last mentioned embodiment permits firing of the fire-producing devices with solid fuels, e.g. by stoking the devices from the roof of the tunnel and permits ashes to be removed from said devices from below the devices to ensure that no ash or residue is carried by the movement of gas into the baking tunnel.

The provision of fire positions within the inwardly extending projections together with the provision of inlet or outlet ports has the advantage that waste material or solid fuel with relatively low specific weight, and of which the ash also has a low specific weight, can be used for firing. Such fuels, for example, are wood, cacao shells and nut shells. Furthermore, it is also possible to fire the oven with sawdust. The outlet ports in the projections are offset, from one another at different heights above the floor of the tunnel which ensures that the fire positions are not directly affected by the main flow of gas through the oven, and that as a result light ashes are not carried along by the current.

It has proved to be especially advantageous that a means for creating a reciprocating flow of gas is situated in the entrance zone and/or in the exit zone of the baking tunnel. Connected to this means, at least at one end of the tunnel, is a further means for receiving various volumes of gas, which can be called a volume compensating means.

According to a further advantageous suggestion, the exhaust from the oven is of a sufficiently high temperature to prevent the release of incompletely burned gas. By this means, exhaust fumes containing harmful material are subjected to a secondary burning. The quality of exhaust gasses thus achieved makes it possible to comply with difficult legal requirements.

Especially advantageous is the fact that the fuel feed to the fire-producing devices occurs in timed relation to the reciprocating movement of the gas stream in the oven. Preferably, the fuel feed takes place during the phase of the reciprocating movement when the gas is stationary.

According to a further suggestion in connection with the invention, the oven is fired at least partially by waste material.

Figure 2:
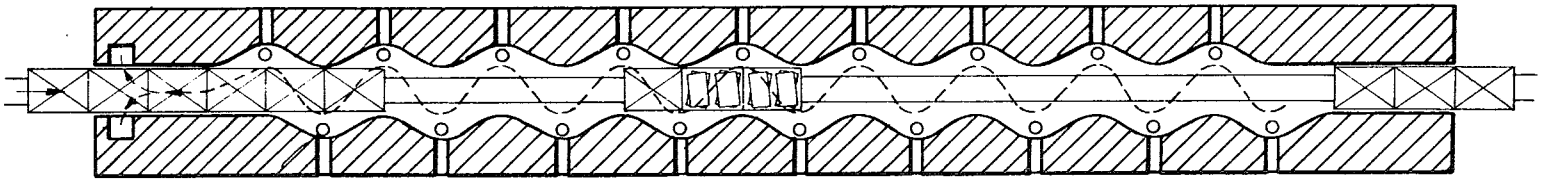
Figure 3:
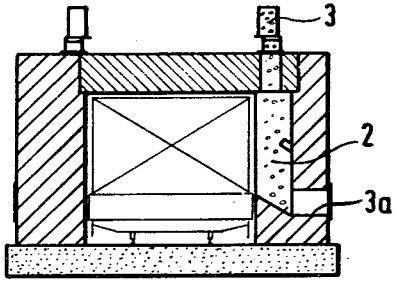
Figures 4, 4A:
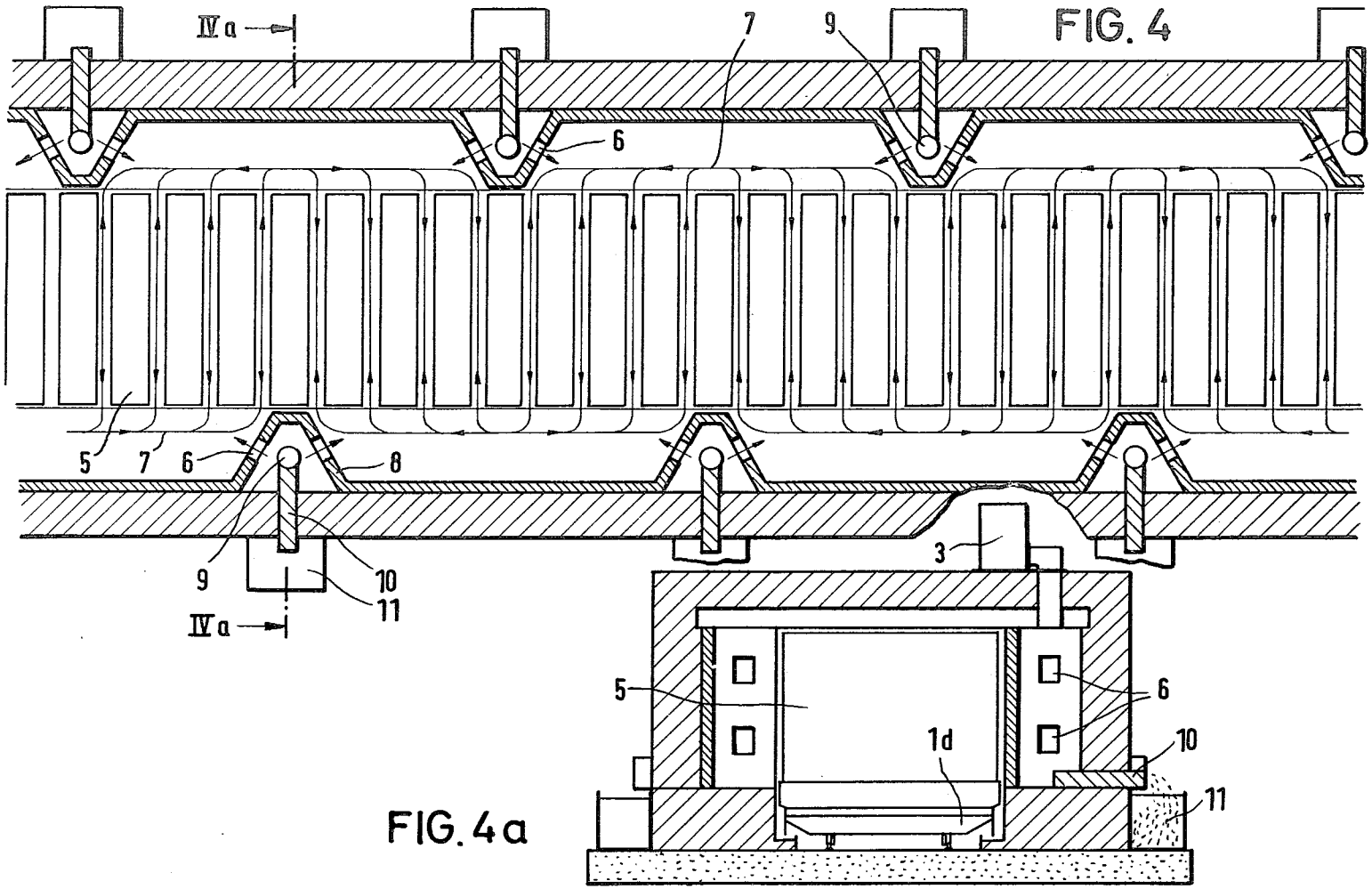
Figure 5:
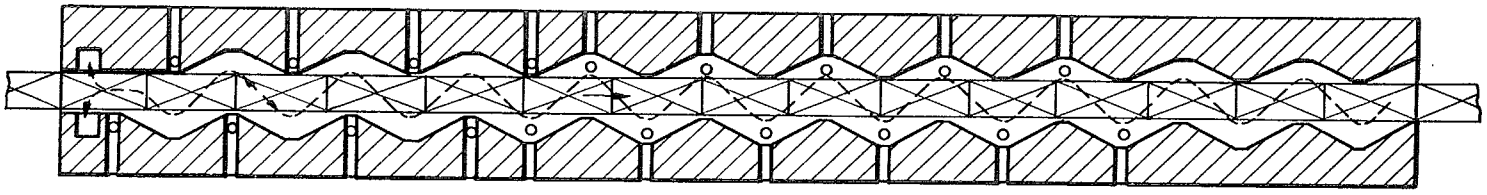
Figure 5A:
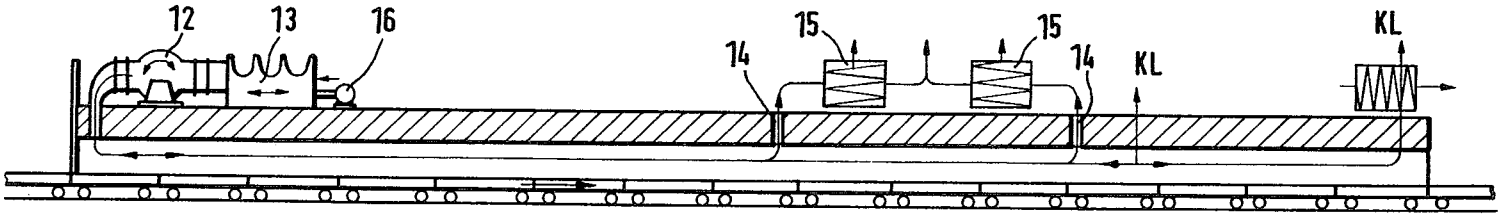
Figure 6:
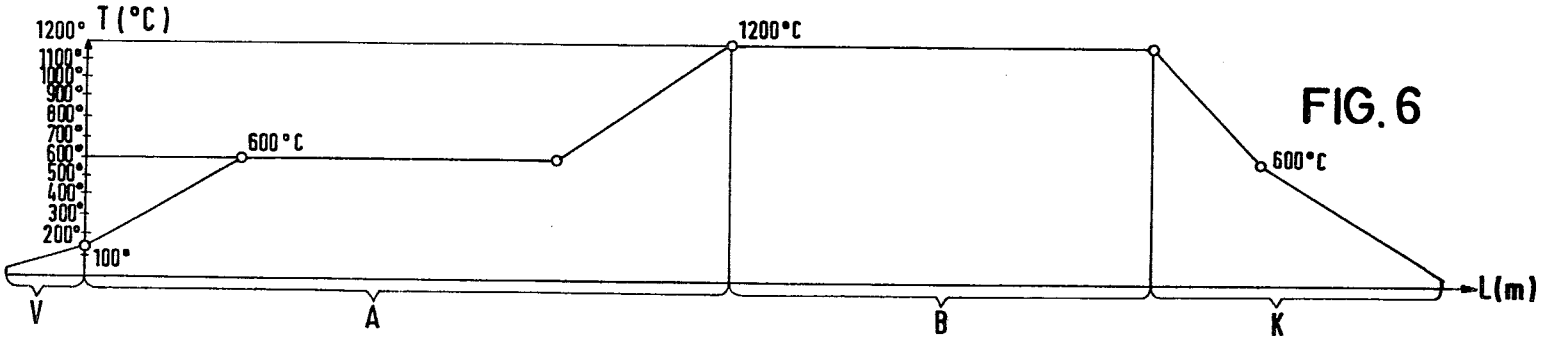

Further characteristics will be apparent from the the drawings and the following description thereof wherein:

FIG. 1 is a horizontal longitudinal section through a tunnel oven with a zigzag shaped baking tunnel, FIG. 2 is a horizontal longitudinal section through a tunnel oven with a wave shaped baking tunnel, FIG. 3 is a section through the tunnel oven according to FIG. 1 in the plane III—III, FIG. 4 is a horizontal longitudinal section through a further embodiment of a tunnel oven, FIG. 4*a* is a section through the plane IV*a*—IV*a* of FIG. 4, FIG. 5 is a horizontally running longitudinal section through a further tunnel oven, FIG. 5*a* is a vertically running longitudinal section through the tunnel oven of FIG. 5 with additional parts diagrammatically indicated, and FIG. 6 is a temperature distribution diagram for the gasses in the tunnel oven of FIGS. 5 and 5*a*.

In FIG. 1 the tunnel oven 1 is provided with a zigzag shaped baking tunnel 1*a* comprising a plurality of wall sections which define inwardly extending projections separated from one another by intervening recesses. The diagrammatically indicated carriages 1*d* move in the direction of the arrow 1*b* through the oven, from left to right as shown in FIG. 1.

The main stream of gas moves generally in the direction of the arrow 1*c* from one end of the tunnel to the other end thereof, from right to left, in opposition to the direction of movement of the carriages 1*d*.

The stream of gas does not, however, move evenly, along the tunnel but makes reciprocating progress e.g., as will be described, as the result of the operation of a reversible blower which is used to produce the stream of gas. A main stream of gas in the direction of the arrow 1*c* is influenced by a pulsating stream of gas. This results in the entire flow of gas making reciprocative progress in a direction generally opposite to the transport direction of the carriages. In practice, the column of gas in the baking tunnel can move flows 30 cm to the left during the first phase of movement. Then in the next phase the column of gas moves 20 cm to the right, thereafter moves a further 30 cm to the left and so on. Between the described phases, the gas is stationary for a short period.

Due to the form of the side walls in the baking tunnel, the gas flows not only in a longitudinal direction through the tunnel, but also moves across the tunnel in a manner symbolized by the broken lines 1*e*.

3 indicates the fire positions for fire-producing devices which are each arranged in the recesses along the inner sidewalls of the tunnel. The recesses on each inner side wall are situated opposite the inwardly extending projections on the other inner side wall. The fire-producing devices in this and the other embodiments of the invention are fed with fuel in timed relation to the aforementioned reciprocating flow of gas, e.g. the fuel feed occurs during the short period of time when the gas is stationary.

The vertical free areas remaining beside the carriage load are indicated with b1 and b2. These are the cross sectional areas of the flow between the carriage load and the inner side walls of the baking tunnel. With the embodiments shown in FIGS. 1 and 2, the sum of the areas b1 and b2 remains the same throughout the entire length of the oven. With this arrangement, a cross flow through the ware to be baked is achieved by suitable positioning thereof. The heat picked up at the fire positions is carried thereby to the inner regions of the load (ware).

Because of the reciprocating forward movement of the column of gas, the transport of heat to the middle of the baking tunnel occurs from both sides.

FIG. 2 shows an embodiment of a construction similar to that in FIG. 1, which differs only from the embodiment of 1 in that instead of the zigzag shape, a wave shaped baking tunnel is provided.

In FIG. 3, the feed position 3 for the solid fuel can be seen. The solid fuel is fed through a feeding mechanism, e.g. a stoker in the roof of the oven into the baking tunnel. The ash is withdrawn from the fire-producing devices through a side opening 3*a*.

Another embodiment of the tunnel oven is illustrated in the FIGS. 4 and 4*a*. With this embodiment the inwardly extending projections are again situated opposite corresponding recesses on the other side. In this case, however, the sum of the cross sectional areas of the flow through the spaces at the sides of the load is not equal throughout the entire length of the oven, as is the case with the embodiments according to FIGS. 1 and 2. A cross flow of the oven gas stream however also occurs with this embodiment. The gas also moves longitudinally in the reciprocative manner described previously.

In this embodiment, the fire positions 9 are situated within the projections 8, and the walls which define the projections are provided with holes 6 for the flow of oven gasses from the fire-producing devices into the tunnel. The holes 6 can be provided on only one side of each projection or, as illustrated in FIG. 4, can be provided on both sides of each projection; and the holes 6 are preferably offset from one another so as to be located at various different heights above the floor of the tunnel. Here too, the fuel is fed in timed relation to the reciprocating flow of gas through the roof of the oven and the ash is removed through an opening in the side by an extracting means 10, for example a screw conveyer, to an outside receptacle 11.

With this embodiment, the fire positions are not directly engaged by the main stream of gas in the oven, and as a result, light ash can not be carried along by the main stream of gas, as might otherwise occur when fuels such as sawdust are used.

Reference numeral 5 indicates the load frame. Heating alleys or passageways are provided between the frames through which the cross currents of the oven gasses can pass.

In FIGS. 5 and 5*a*, a further embodiment is shown. The baking tunnel of this embodiment is also substantially zigzag shaped, and the gas flows in the manner previously described.

In the illustrated embodiment, exhaust gasses containing harmful material can be effectively cleaned by being subjected to secondary burning. The flow of gas in this oven, especially in the warming up zone, (i.e. zone A of FIG. 6) is turbulent. With the oven shown, great efficiency can be achieved while conforming to stable conditions. It can be ensured thereby, that the warming up curve (the temperature curve diagram of the warming up zone), because of the carbonizing process, can be influenced at will, that is independent of the other oven zones and their thermal and atmospheric conditions. It is possible with this embodiment to avoid the usually unavoidably rising, often disadvantageous form of warming up curve of this opposing flow type of heating. Instead, it is possible to achieve a long period of dwell at a desired temperature even in the warming up zone. This is valid for temperatures at which the formation of unburned gasses is intensive and the combustion temperature is not yet reached.

Furthermore, this embodiment provides a solution to the problem of retaining the incompletely burned gasses sufficiently long in a high temperature zone in the oven to completely burn them, and to operate the oven with a minimum of surplus air so that the oven can be operated in a very economical manner.

Also, with this embodiment, the oven is heated with solid, liquid or gaseous fuel via inwardly extending wall projections in the area of the warming up zone, which direct the developing heating gasses through outlet ports in said projections into the main stream of gas. The burning chambers formed within the projections are at a sufficiently high temperature to burn all the fuel provided there. Ensured thereby is that adjacent fuel is not thermally endangered.

There are no outlet ports for smoke in the entrance area of the warming up zone, so that no incompletely burned gasses can escape into the atmosphere at the oven entrance. Instead, a reversible blower 12 or gas delivery means with reversible flow, and a volume compensating means 13 are fitted in the entrance area of the warming up zone. These means can also be arranged at the oven exit of a closed baking tunnel, or at both ends of the oven. The arrangement at both ends of the oven is of especial advantage for long tunnels.

The reversible blower 12 effects the reciprocating flow of a main stream of gas, as previously described, and alternates the direction of the flow of gas in a rapid succession of only a few seconds, displacing the volume of gas from the baking tunnel into the volume compensating means 13 which is sealed off from the outside atmosphere. In the next moment, the volume of gas delivered to the volume compensating means 13 is extracted therefrom and returned to the baking tunnel. Thus gas flow conditions of extremely turbulent cross currents are created. Because of this, a good transfer of heat from the oven gas to the ware being baked is ensured. At the fire positions of the warming up zone, the heating gasses are mixed, via the aforementioned openings, in the wall projections with the main stream of gas, which results in the warming up zone of the tunnel oven being heated.

The incompletely burned gasses which develop in the warming up zone from the ware, are rhythmically displaced, together with the gasses from the fire positions of the warming up zone, through the warming zone to the baking or firing zone, and are led off either within the firing zone or the transition to the cooling zone, (zone K of FIG. 6) through outlets 14 to a heat exchanger 15 or some other consuming device. In any event, the exhaust fumes created in the low temperature area of the warming up zone A are completely burned in the high temperature area, and the odorous substances oxidized before extraction from the oven.

An indirect means for heating the warming zone, such as an electric heater, can also be provided. The feed of fuel for heating the oven should, as mentioned previously, occur substantially at the point in time when a change in the direction of the flow of gas is about to take place. During this time, there is no, or nearly no current of gas in the baking tunnel, so that no fuel dust or ash is carried to the ware load.

FIG. 6 shows one of many possible temperature curve diagrams for the tunnel oven, of FIGS. 5 and **5*a* whereby the characteristic of the warming up flank is substantially different from that of the cooling flank. The cooling of the wares takes place in the tunnel oven in a known manner using air, or indirectly with the aid of a heat exchanger which is attached to the tunnel in the area of cooling zone and permits cooling with reducing atmosphere. To avoid corrosion in the gas delivery means and in the volume compensating means, these means are pre-filled with a certain amount of hot air 16**, so that the endangered parts are protected from the corroding influence of incompletely burned gasses.

The warming zone is referenced in FIG. 6 with "A", the baking zone with "B", the cooling zone with "K" and the extraction of cooling air from the cooling zone with "KL".

I claim:

1. A tunnel oven for baking ceramic products, said oven comprising a tunnel of elongated configuration having at least one movable carriage therein for carrying products to be baked from one end of the tunnel to the other, gas-producing means for producing a stream of heated gas which flows along the length of said tunnel through a first distance opposite to the direction of movement of said carriage and thereafter through a lesser distance in the direction of movement of said carriage whereby said stream of gas flows in reciprocating fashion through said tunnel in a general direction opposite to the direction of movement of said carriage, each inner side wall of said tunnel including a plurality of inwardly extending projections spaced from one another by recesses, said gas-producing means comprising fire producing means located in each of said recesses, the inwardly extending projections on each of said side walls being disposed respectively opposite to the recesses on the other of said side walls, said projections and recesses being operative to produce cross currents in said reciprocating stream of heated gas which causes said stream of heated gas to flow through said recesses and fire producing means along a generally sinuous path which periodically crosses the axis of said tunnel in a flow direction opposite to the direction of movement of said carriage.

2. The tunnel oven of claim 1 wherein said projections are defined by flat portions of each of said inner side walls which are disposed adjacent to one another and which extend respectively in differing directions transverse to the axis of said tunnel.

3. The tunnel oven of claim 2 wherein each of said inner side walls exhibits a zigzag configuration along the length of said tunnel.

4. The tunnel oven of claim 1 wherein said inner side walls each have a smoothly curved wave configuration along the length of said tunnel, the projections on each of said inner side walls being defined by those portions of said wave configuration which extend inwardly toward the axis of said tunnel, and the recesses on each of said inner side walls being defined by the intervening portions of said wave configuration which extend away from the axis of said tunnel.

5. The tunnel oven of claim 1 wherein the sum of the distances between the opposite sides of the load on said carriage and the inner side walls of said tunnel which respectively face the opposite sides of said carriage is substantially constant throughout the length of said tunnel.

6. The tunnel oven of claim 1 wherein said tunnel includes exhaust means for removing exhaust fumes from said tunnel, and means for maintaining said exhaust means at a temperature sufficiently high to effect substantially complete combustion of said exhaust fumes.

7. The tunnel oven of claim 6 including a heat exchanger connected to said exhaust means.

8. The tunnel oven of claim 1 wherein said products to be baked are carried by said carriage in a plurality of stacks which are oriented on said carriage in directions transverse to the axis of said tunnel, said stacks being spaced from another to provide passageways therebetween oriented at acute angles to the axis of said tunnel for the flow of said cross currents between said stacks.

9. A tunnel oven for baking ceramic products, said oven comprising a tunnel of elongated configuration having at least one movable carriage therein for carrying products to be baked from one end of the tunnel to the other, gas-producing means for producing a stream of heated gas which flows along the length of said tunnel through a first distance opposite to the direction of movement of said carriage and thereafter through a lesser distance in the direction of movement of said carriage whereby said stream of gas flows in reciprocating fashion through said tunnel in a general direction opposite to the direction of movement of said carriage, each inner side wall of said tunnel including a plurality of inwardly extending projections spaced from one another by recesses, said gas-producing means comprising fire-producing means located within each of said projections, the wall portions of each of said side walls which define said inwardly extending projections including ports therein for the flow of heated gases from said fire-producing means into said tunnel, the inwardly extending projections on each of said side walls being disposed respectively opposite to the recesses on the other of said side walls, said projections and recesses being operative to produce cross currents in said reciprocating stream of heated gas which causes said stream of heated gas to flow along a generally sinuous path which periodically crosses the axis of said tunnel in a flow direction opposite to the direction of movement of said carriage.

10. The tunnel oven of claim 9 wherein the opposite sides of each of said projections are defined by a pair of oppositely inclined, adjacent wall portions which extend transverse to the axis of said tunnel, each of said oppositely inclined wall portions including at least one of said ports therein.

11. The tunnel oven of claim 9 wherein said ports are located on only one side of said projections.

12. The tunnel oven of claim 9 wherein said ports are located in said projections at a plurality of different heights above the floor of said tunnel.

13. A tunnel oven for baking ceramic products, said oven comprising a tunnel of elongated configuration having at least one movable carriage therein for carrying products to be baked from one end of the tunnel to the other, gas-producing means for producing a stream of heated gas which flows along the length of said tunnel through a first distance opposite to the direction of movement of said carriage and thereafter through a lesser distance in the direction of movement of said carriage whereby said stream of gas flows in reciprocating fashion through said tunnel in a general direction opposite to the direction of movement of said carriage, said gas-producing means comprising a reversible blower located at one end of said tunnel, each inner side wall of said tunnel including a plurality of inwardly extending projections spaced from one another by recesses, the inwardly extending projections on each of said side walls being disposed respectively opposite to the recesses on the other of said side walls, said projections and recesses being operative to produce cross currents in said reciprocating stream of heated gas which causes said stream of heated gas to flow along a generally sinuous path which periodically crosses the axis of said tunnel in a flow direction opposite to the direction of movement of said carriage.

14. The tunnel oven of claim 13 wherein said one end of said tunnel is the end at which said carriage enters said tunnel.

15. The tunnel oven of claim 13 wherein said one end of said tunnel is the end at which said carriage exits from said tunnel.

16. The tunnel oven of claim 13 including means connected to at least one end of said tunnel for receiving various volumes of gas.

17. A tunnel oven for baking ceramic products, said oven comprising a tunnel of elongated configuration having at least one movable carriage therein for carrying products to be baked from one end of the tunnel to the other, gas-producing means for producing a stream of heated gas which flows along the length of said tunnel through a first distance opposite to the direction of movement of said carriage and thereafter through a lesser distance in the direction of movement of said carriage whereby said stream of gas flows in reciprocating fashion through said tunnel in a general direction opposite to the direction of movement of said carriage, said gas-producing means including a plurality of fire-producing devices located in spaced relation to one another along the inner side walls of said tunnel for heating said stream of gas, and means for feeding fuel to said devices in timed relationship to the flow reciprocations of said stream of gas, each inner side wall of said tunnel including a plurality of inwardly extending projections spaced from one another by recesses, the inwardly extending projections on each of said side walls being disposed respectively opposite to the recesses on the other of said side walls, said projections and recesses being operative to produce cross currents in said reciprocating stream of heated gas which causes said stream of heated gas to flow along a generally sinuous path which periodically crosses the axis of said tunnel in a flow direction opposite to the direction of movement of said carriage.

18. The tunnel oven of claim 17 wherein fuel is fed to said devices between the opposite directions of movement of said reciprocating stream of gas when said stream of gas is substantially stationary.

19. The tunnel oven of claim 17 wherein said means for feeding fuel comprises a stoker for feeding a solid fuel to said devices from the roof of said tunnel, and means below said devices for removing ashes therefrom.

* * * * *